United States Patent [19]

Raar

[11] Patent Number: 4,940,345

[45] Date of Patent: Jul. 10, 1990

[54] INK CASSETTE AND INK TRANSFER ROLL THEREFOR

[75] Inventor: Hans Raar, An Cuyk, Netherlands

[73] Assignee: Merlin C.T.C. Production Division Nederland B.V., Netherlands

[21] Appl. No.: 263,878

[22] Filed: Oct. 28, 1988

[30] Foreign Application Priority Data

Oct. 28, 1987 [NL] Netherlands ..... 8702567

[51] Int. Cl.[5] ..... B41J 33/10

[52] U.S. Cl. ..... 400/195; 400/196

[58] Field of Search ..... 400/194, 195, 196, 197

[56] References Cited

U.S. PATENT DOCUMENTS

| | | | |
|---|---|---|---|
| 3,989,132 | 11/1976 | Carson | 400/195 |
| 4,493,572 | 1/1985 | Van Ocker et al. | 400/196.1 |
| 4,636,097 | 1/1987 | Goubeaux | 400/196.1 |
| 4,741,639 | 5/1988 | Fausto et al. | 400/196.1 |

*Primary Examiner*—Edgar S. Burr
*Assistant Examiner*—Joseph R. Keating
*Attorney, Agent, or Firm*—Watson, Cole, Grindle & Watson

[57] ABSTRACT

In a cassette for a printer unit, comprising an endless ribbon to be provided with ink, means are provided for intermittently applying ink to said ribbon. These means for applying ink comprise a freely movable wheel enclosed between the ink source and the ribbon and between connecting elements of houding and/or cover of the cassette.

4 Claims, 2 Drawing Sheets

INK CASSETTE AND INK TRANSFER ROLL THEREFOR

Printer apparatus is used more amd more as the use of (personal) computers has increased constantly over the past years. More and more development has been aimed at obtaining ink cassettes which have a long and lasting life cycle, viz. are capable of printing more and more characters, and which are also easy to construct, preferably with commonly available components.

U.S. Pat. No. 4,091,914 discloses an apparatus for delayed replanishment of making fluid to a ribbon, which is mounted for rotation onto an axis by means of a bearing and which therefor requires a substantial amount of torsional driving force.

The ink cassette according to the present invention is capable of printing more than five million characters on paper without the blackness or reflection value on the paper falling to below 50% of the initial value. Also prevented is that too much ink gets onto the paper, since excessive local accumulation of ink on the ribbon, so-called hot spots, are prevented.

Further the ink cassette according to the present invention can be driven with a relatively small rotation moment, viz. $10^{-4}$ Nm.

Furthermore the present invention relates to an ink transfer roll.

Figure 1:
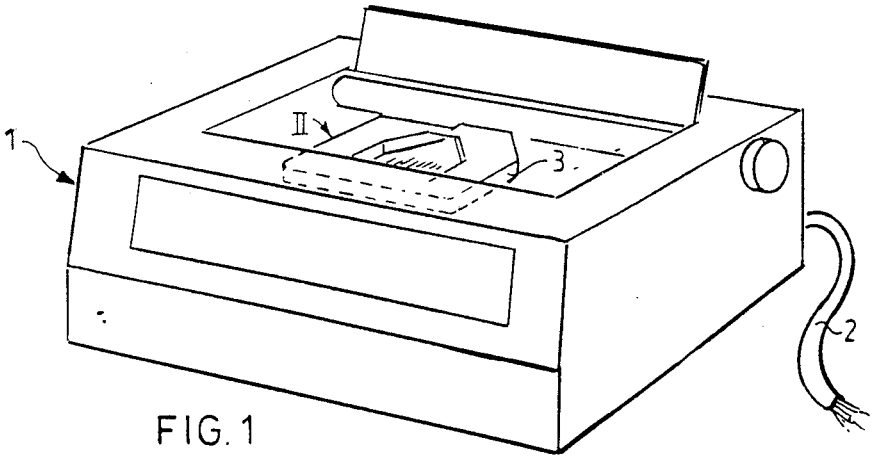
Figure 2:
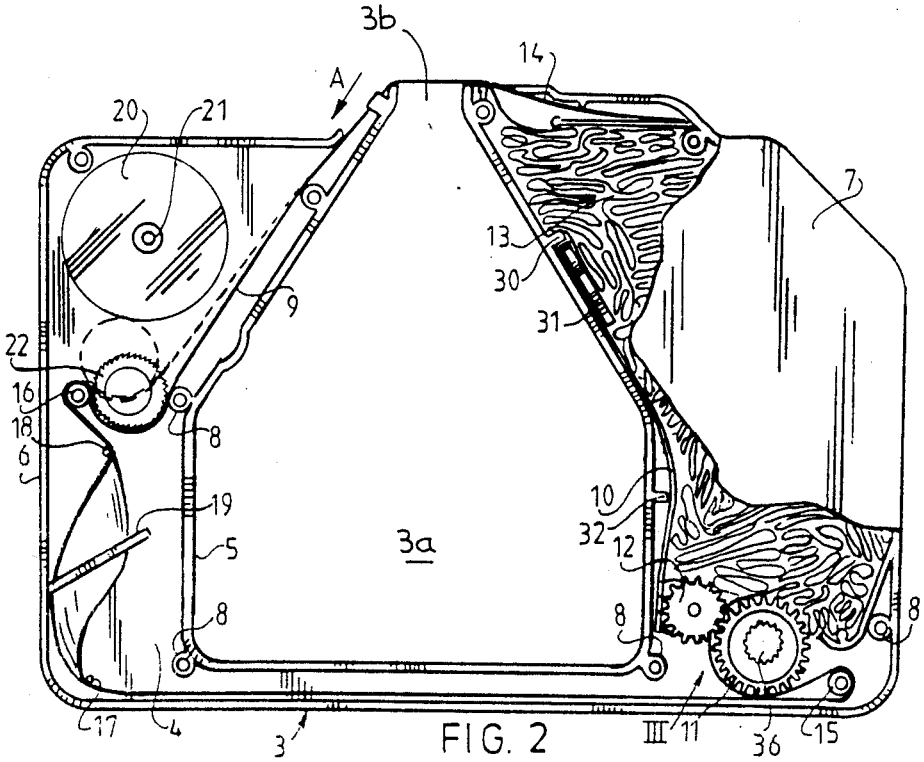
Figure 3:
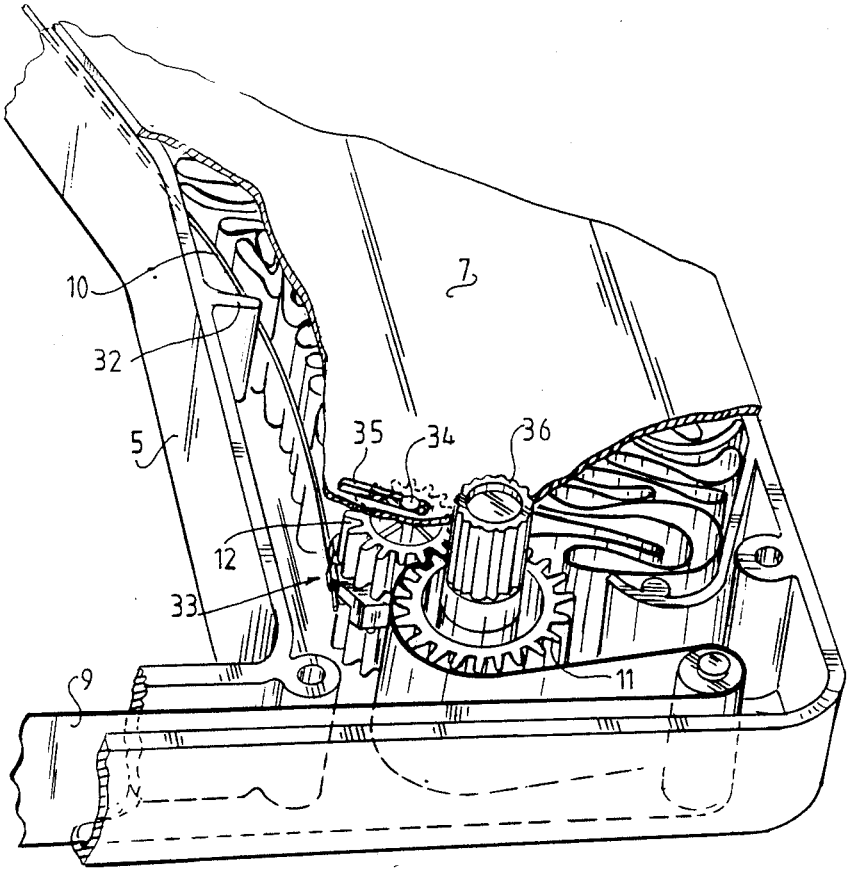

Further advantages, features and details will be elucidated with reference to a drawing, in which:

FIG . 1 shows a schematic, perspective view of a printer unit provided with a cassette according to a preferred embodiment of the present invention;

FIG. 2 is c partly broken away, enlarged top view of detail II from, FIG. 1; and FIG. 3 is a perspective, partly broken away view of detail III from FIG. 2.

A printer unit 1, connected in manner not shown to a computer, for example via cable 2, requires a cassette 3 provided with ink ribbon, for example 13 mm in height, in order to enable a matrix head or other head of the printer unit to print particular characters on paper in ink.

A cassette 3 (FIG. 2) has a form dictated by the 5 type of printer and comprises a housing or bottom plate 4, usually of injection moulded plastic, and provided with standing inner and outer edges 5 and 6, respectively. Fitting onto the housing 4 is a cover 7, likewise usually of injection moulded plastic; cover 7 is provided with co-moulded pins which fit into bushes 8 co-moulded with housing 4. The housing and cover define an internal chamber **3*a* having an externally-exposed opening 3*b*. A woven ribbon 9 made endless by means of a seam is moved along and over the opening 3*b* in the direction of arrow A and into an infeed compartment on one side of the opening 3*b* by a transporting member which is for coupling to a drive member in the printer unit and which is formed by a toothed wheel 11, this wheel 11 being in engagement with a second toothed wheel 12. The second gear wheel 12 is pressed by means of a pin-like (elongated) spring 10 against toothed wheel 11. After the ribbon 9 has passed through between the toothed wheels 11 and 12 it comes into the storage chamber 13, which is located on the other side of opening 3*b* and in the present case makes up substantially half of the volume of the cassette (so as to be able to contain as much coiled and winding ribbon as possible.) Clamped onto the ribbon at the exit to the ribbon chamber 13 is a leaf spring 14. The ribbon 9 is further trained along the small rollers 15 and 16 as well as along pins 17 and 18 and is turned over under a partition member 19, a so-called Möbius turn, in order to use the ribbon as long and as efficiently as possible. A roll 20 consisting of polyurethane foam (PUR) is mounted for rotation about a pin 21**. This roll is saturated with ink and forms an ink buffer for the purpose of applying ink to the ribbon in sufficient but not excessive measure during the printing of five million characters.

If tension is exerted on the ribbon 9 in the direction of arrow A, that is, when the toothed wheel 11 exercises a force on the ribbon, a freely movable intermediate roll 22 is pressed against the ink roll 20; during transport of the ribbon 9 the intermediate roll 22, because of its rough surface, turns with the movement of the ribbon and likewise sets the ink roll 20 into motion. During this rotary movement ink transfer from ink roll 20 to intermediate roll 22 takes place. The intermediate roll 22 is preferably made of plastic and is ribbed in the direction perpendicular to FIG. 2. The ribbing on intermediate roll 22 preferably takes a slightly hook-shaped or asymmetrical form in order to bring about a (still) better gripping on the ribbon during transport of this ribbon in the direction of arrow A.

Through intermediate roll 22 is prevented that when ribbon 9 is at standstill, that is when printing onto the paper is taking place, too much ink is applied locally to the ribbon, which after further transport will result in smudgy print work. The intermediate roll 22 only takes up ink from the ink wheel when the ribbon is being transported, while the ink roll thereby also rotates, so that there takes place an immediate and uniform transfer from ink roll 20 to intermediate roll 22 and therefore to ribbon 9.

In case of the preferred embodiment of the ink cassette according to the present invention shown in FIG. 2 and 3, transport of the ribbon 9 is performed lightly and using simple means. The pin-like spring 10 is fixed in position in the housing between a protrusion 30 in the bottom of the housing and a standing portion 31, is bent over a protrusion 32 on the inner edge 5 and clamped against a bearing 33 on the second toothed wheel 12. The latter is furnished on its end with pins 34, one of which is shown, which are received into slots 35 in both bottom and the cover 7 of the housing, the slot in the cover being visible in FIG. 3. The spring 10, in coaction with the slots 35 and the second toothed wheel 12, in this way provides a constant press-on force on the first gear wheel 11. This toothed wheel 11 is provided with a ribbed control knob 36 for manual operation of this toothed wheel. Arranged for toothed wheel 11 on the underside of the cassette is a drive opening for engagement to a drive member of the printer unit. The toothed wheel is driven at the moment that the matrix head carries ink over onto the paper so that at the time the matrix head is not applying ink to the paper the ink is being transported out of the storage area 13 in the vicinity of the leaf spring 14. Since the ribbon is pressed firmly between the first and second gear wheels 11 and 12, ribbon transport is carried out precisely and the first gear wheel need be driven only with a small turning moment, for instance 180 cNcm—the inner diameter of the first gear wheel amounts for example to 1.5 cm.

Futhermore the press-on force of the intermediate roll 22 on the PUR roll 20 is determined by the tension in the ribbon, which results in this press-on force not becoming subject to wear of the ink roll 20 and intermediate roll 22.

It should be apparent that the shown preferred embodiment according to the present invention not only enables printing onto paper of a large number of characters with sufficient blackness, but also effects this with extremely simple and economically realisable means.

I claim:

1. A long-lasting cassette for use in a printing unit, said cassette comprising:

a housing which includes outer walls and inner walls, said walls forming an internal chamber having an externally-exposed opening and, together with the outer walls, forming infeed and storage compartments on opposite sides of the internal chamber which respectively have mouths adjacent to externally exposed opening, a rotatable ink roll located in the infeed compartment, a rotatable intermediate roll located in the infeed compartment and mounted to be movable towards any away from the rotatable ink roll, a first guide roll located in the infeed compartment, a partition member located in the infeed compartment, a pair of rotatable drive wheels located in the storage compartment, a first drive wheel of the pair of drive wheels being movable towards and away from the second drive wheel of the pair of drive wheels, an elongated spring means which contacts the first drive wheel to urge it towards the second drive wheel and define a nip therebetween, a second guide roll located in the storage compartment, an endless mobius ribbon which sequentially extends out of the mouth of the storage compartment and across the externally-exposed opening, through the mouth of the infeed compartment and into the infeed compartment, around a portion of the periphery of the intermediate roll, around the first guide roll, over the partition member so as to be reversed in orientation, around the second guide roll so as to be reversed in direction, around a portion of the periphery of the second drive wheel and through the nip between the first drive wheel and the second drive wheel, and after forming an accumulation in the storage compartment, out of the mouth of the storage compartment, and engagement means for contacting the mobius ribbon to provide tension therein when moved by the pair of drive wheels out of the mouth of the storage compartment, movement of the tensioned mobius ribbon over the intermediate roll and around the first guide roll causing the intermediate roll to contact the ink roll so that the intermediate roll can transfer ink from the ink roll to the mobius ribbon.

2. A cassette as defined in claim 1, wherein said first and second drive wheels comprise toothed wheels.

3. A cassette as defined in claim 2, wherein said elongated spring means comprises has opposite first and second ends, said first end being fixed in position against an inner wall of the housing and said second end contacting first drive wheel.

4. A cassette as defined in claim 1 wherein said engagement means comprises a leaf spring which presses the mobius ribbon against an inner wall of the housing.

* * * * *